US008042465B2

(12) United States Patent
Schmidt et al.

(10) Patent No.: US 8,042,465 B2
(45) Date of Patent: Oct. 25, 2011

(54) METHOD AND DEVICE FOR SWITCHING BETWEEN SINGLE-SIDED OR STRAIGHT PRINTING MODE AND PERFECTING OR RECTO/VERSO PRINTING MODE IN A SHEET-PROCESSING MACHINE AND REVERSING DRUM HAVING THE DEVICE

(75) Inventors: Thomas Schmidt, Eppelheim (DE); Karl-Heinz Helmstädter, Kaiserslautern (DE); Ernst-Christian Maschler, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1021 days.

(21) Appl. No.: 11/875,981

(22) Filed: Oct. 22, 2007

(65) Prior Publication Data

US 2008/0092607 A1 Apr. 24, 2008

(30) Foreign Application Priority Data

Sep. 20, 2006 (DE) ..... 10 2006 044 062

(51) Int. Cl.
*B41F 21/00* (2006.01)
*B41F 21/10* (2006.01)

(52) U.S. Cl. ..... 101/246; 101/230; 101/409

(58) Field of Classification Search ..... 101/230, 101/246, 410, 408–409; 271/225; 70/174
See application file for complete search history.

(56) References Cited

U.S. PATENT DOCUMENTS

| | | | | |
|---|---|---|---|---|
| 4,343,241 | A * | 8/1982 | Rudolph et al. | 101/231 |
| 4,448,125 | A * | 5/1984 | Kawaguchi et al. | 101/185 |
| 4,928,586 | A * | 5/1990 | Kida | 101/230 |
| 5,076,164 | A | 12/1991 | Becker | |
| 5,762,333 | A | 6/1998 | Sugiyama et al. | |

FOREIGN PATENT DOCUMENTS

| | | | |
|---|---|---|---|
| DE | 3911609 | C2 | 10/1990 |
| DE | 4118584 | C2 | 12/1992 |
| DE | 4324746 | C2 | 1/1995 |
| JP | 63053037 | A | 3/1988 |

OTHER PUBLICATIONS

German Search Report, dated Mar. 1, 2007.

* cited by examiner

*Primary Examiner* — Ren Yan
*Assistant Examiner* — Marissa L Ferguson-Samreth
(74) *Attorney, Agent, or Firm* — Laurence A. Greenberg; Werner H. Stemer; Ralph E. Locher

(57) ABSTRACT

A method and a device for converting a mode of operation from straight printing to perfecting in a sheet-processing machine, includes a cam/follower control for operating a gripper system, in which cam followers are maintained in a position in which they are disengaged from control cams before a conversion of the mode of operation is performed. The method and the device convert a gripper system of a reversing drum between a straight or one-sided printing mode and a perfecting or recto-verso printing mode, by controlling pivoting and opening movements of grippers of the gripper system with a control cam. Initially, a cam follower is locked in a position in which it is disengaged from the control cam. Subsequently, a further cam follower is locked in a position in which it is disengaged from a further control cam. Then the gripper system is converted.

7 Claims, 6 Drawing Sheets

METHOD AND DEVICE FOR SWITCHING BETWEEN SINGLE-SIDED OR STRAIGHT PRINTING MODE AND PERFECTING OR RECTO/VERSO PRINTING MODE IN A SHEET-PROCESSING MACHINE AND REVERSING DRUM HAVING THE DEVICE

CROSS-REFERENCE TO RELATED APPLICATION

This application claims the priority, under 35 U.S.C. §119, of German Patent Application DE 10 2006 044 062.5, filed Oct. 20, 2006; the prior application is herewith incorporated by reference in its entirety.

BACKGROUND OF THE INVENTION

Field of the Invention

The invention relates to a method and a device for switching between a single-sided or straight printing mode and a perfecting or recto/verso printing mode in a sheet-processing machine. The invention also relates to a reversing drum having the device.

When the mode of operation of a sheet-processing machine is changed from single-sided or straight printing to perfecting or recto/verso printing, pivoting movements and opening times of cam-controlled grippers in the machine must be adjusted appropriately. For that purpose, either cam followers are displaced or shifted on the control cams or the control cams are displaced or shifted below cam rollers. A further possibility is to stop or turn off the gripper movements by a partial blocking or locking.

German Patent DE 39 11 609 C1, corresponding to U.S. Pat. No. 5,076,164, discloses, for example, a reversing or turning device wherein a carriage carrying the cam followers is displaced when the mode of operation changes from straight printing or single-sided printing, to perfecting or recto-verso or double-sided printing. Due to that measure, the cam followers are brought into contact with a respectively adjacent control cam.

Due to the increasing circumferential speeds of the paper-guiding cylinders, the demand for printing presses processing or producing at ever increasing speeds results in greater centrifugal forces at the cam followers. Consequently, greater contact pressures are required to prevent the cam followers from losing contact with the control cams. When the operating mode is changed, the greater contact pressures cause greater frictional forces when the cam followers or control cams are displaced.

SUMMARY OF THE INVENTION

It is accordingly an object of the invention to provide a method and a device for switching between a single-sided or straight printing mode and a perfecting or recto/verso printing mode in a sheet-processing machine and a reversing drum having the device, which overcome the hereinafore-mentioned disadvantages of the heretofore-known methods and devices of this general type and which convert gripper control at the reversing drum with very low forces.

With the foregoing and other objects in view, there is provided, in accordance with the invention, a method for converting a gripper system of a reversing drum between straight or one-sided printing mode and perfecting or recto-verso printing mode. The method comprises controlling pivoting and opening movements of grippers of the gripper system by a control cam, initially locking a cam follower in a position wherein it is disengaged from the control cam, subsequently locking a further cam follower in a position wherein it is disengaged from a further control cam, and subsequently converting the gripper system.

In accordance with another mode of the invention, the method further includes rotating the reversing drum so as to attain the disengaged positions.

In accordance with a further mode of the invention, the method further includes, for the purpose of attaining the disengaged positions, providing actuators for actively pivoting the cam followers until a corresponding spacing from the respective control cams is reached.

With the objects of the invention in view, there is also provided a device for locking a respective cam follower in a position wherein the cam follower is disengaged from a control cam cooperating with the cam follower. The device comprises a locking element for each cam follower, and an axially displaceable adjustment unit of a reversing drum. The locking element is disposed on the adjustment unit, and an actuator brings the locking element from a rest position into a locking position.

In accordance with a further feature of the locking device, the locking element is disposed so that it is movable into a space between a stop and an abutment of the adjustment unit of the reversing drum.

In accordance with an added feature of the invention, the locking device further includes a toothed segment carrying the cam follower. The toothed segment has a journal whereon the stop is disposed.

In accordance with an additional feature of the invention, the locking device further includes a toothed segment having a support roller. The locking element is formed as a guide and is disposed so as to be brought into operative contact with the support roller.

With the objects of the invention in view, there is additionally provided a device for locking a respective cam follower in a position wherein the cam follower is disengaged from a control cam cooperating with the cam follower. The device comprises a toothed segment having a support roller, a locking element to be disposed in a stationary position, and a motor spindle transmission unit for moving the locking element against the support roller.

With the objects of the invention in view, there is furthermore provided a reversing drum, comprising the device according to the invention. The reversing drum is part of a sheet-processing printing press.

A particular advantage of the invention is that a necessary conversion of a reversing drum from straight or single-sided printing to perfecting or recto-verso printing requires only very low forces. The useful life of the control cams and the cam followers may be increased due to this measure.

The reduction of these frictional forces is advantageously achieved by disengaging the cam followers, which are pressed against the control cams by spring forces, before the conversion is initiated.

Another particular advantage is the provision of actuators that are fixed to the cylinder, the actuators being, for example, pneumatic cylinders for indirectly locking the cam follower in a disengaged position. Compressed air for the pneumatic cylinders may be supplied through a rotary feedthrough.

In accordance with a further advantageous embodiment of the invention, a pivotal toothed segment that supports the cam follower is directly locked by a pivot lever.

In accordance with a concomitant advantageous embodiment of the invention, a device that is disposed to be stationary, namely a motor spindle transmission unit, pivots the toothed segment into a position wherein the cam follower is disengaged from the control cam.

Other features which are considered as characteristic for the invention are set forth in the appended claims.

Although the invention is illustrated and described herein as embodied in a method and a device for switching between a single-sided or straight printing mode and a perfecting or recto/verso printing mode in a sheet-processing machine and a reversing drum having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
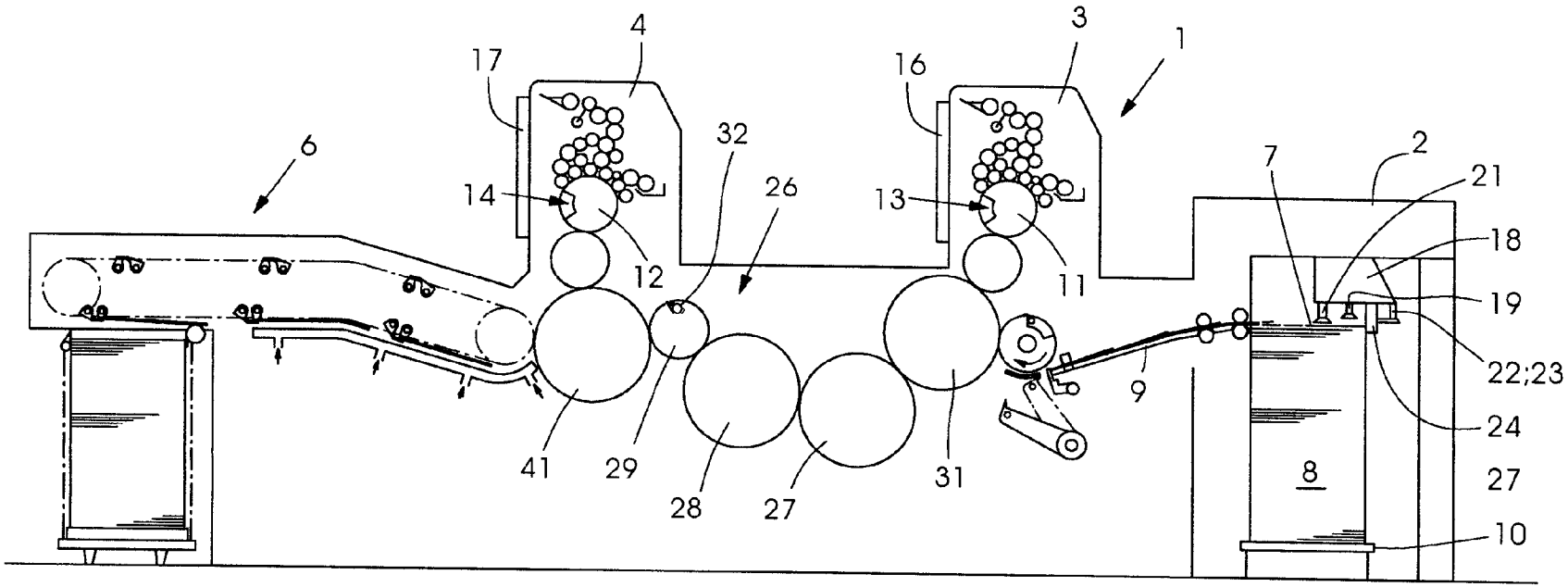
FIG. 1 is a diagrammatic, longitudinal-sectional view of a sheet-fed rotary printing press constructed in accordance with the invention.

Referring now to the figures of the drawings in detail and first, particularly, to FIG. 1 thereof, there is seen a sheet-processing machine, for example a printing press 1, which includes a feeder 2, at least one printing unit 3, 4 and a delivery 6. Sheets 7 are withdrawn from a sheet pile 8 and are fed as individual sheets or in a shingled stream to the printing units 3 and 4 over a feed table 9. Each of the printing units 3 and 4 includes a plate cylinder 11, 12, as known in the art. Each of the plate cylinders 11 and 12 includes a device for affixing flexible printing plates. In addition, a device 16, 17 provided for semi-automatic or fully automatic plate changing is associated with each of the cylinders 11 and 12.

The sheet pile 8 rests on a pile plate 10 which can be lifted in a controlled manner. The sheets 7 are removed from the top of the sheet pile 8 by a so-called suction head 18, which has, among others, a number of lifting and dragging suction cups 19, 21 for separating the sheets 7. Moreover, blower devices 22 for loosening the upper layers of sheets, as well as sensing elements 23 for initiating the lifting of the sheet pile 8, are provided. A number of lateral and trailing-edge stops 24 are provided for aligning the sheet pile 8, in particular the upper sheets 7 in the sheet pile 8.

A three-drum reversing device 26, which includes a transfer drum 27, a storage drum 28 and a reversing drum 29, is provided between two impression cylinders 31 and 41. The reversing drum 29 has a so-called tongs-type gripper system 32 for reversing the sheets in the perfecting mode, i.e. in a printing mode wherein both sides of the sheets are printed in one pass, as opposed to a straight or single-sided printing mode wherein only one side of the sheets is being printed. The remaining sheet-guiding cylinders include two respective gripper systems for transporting the sheets.

Figure 2:
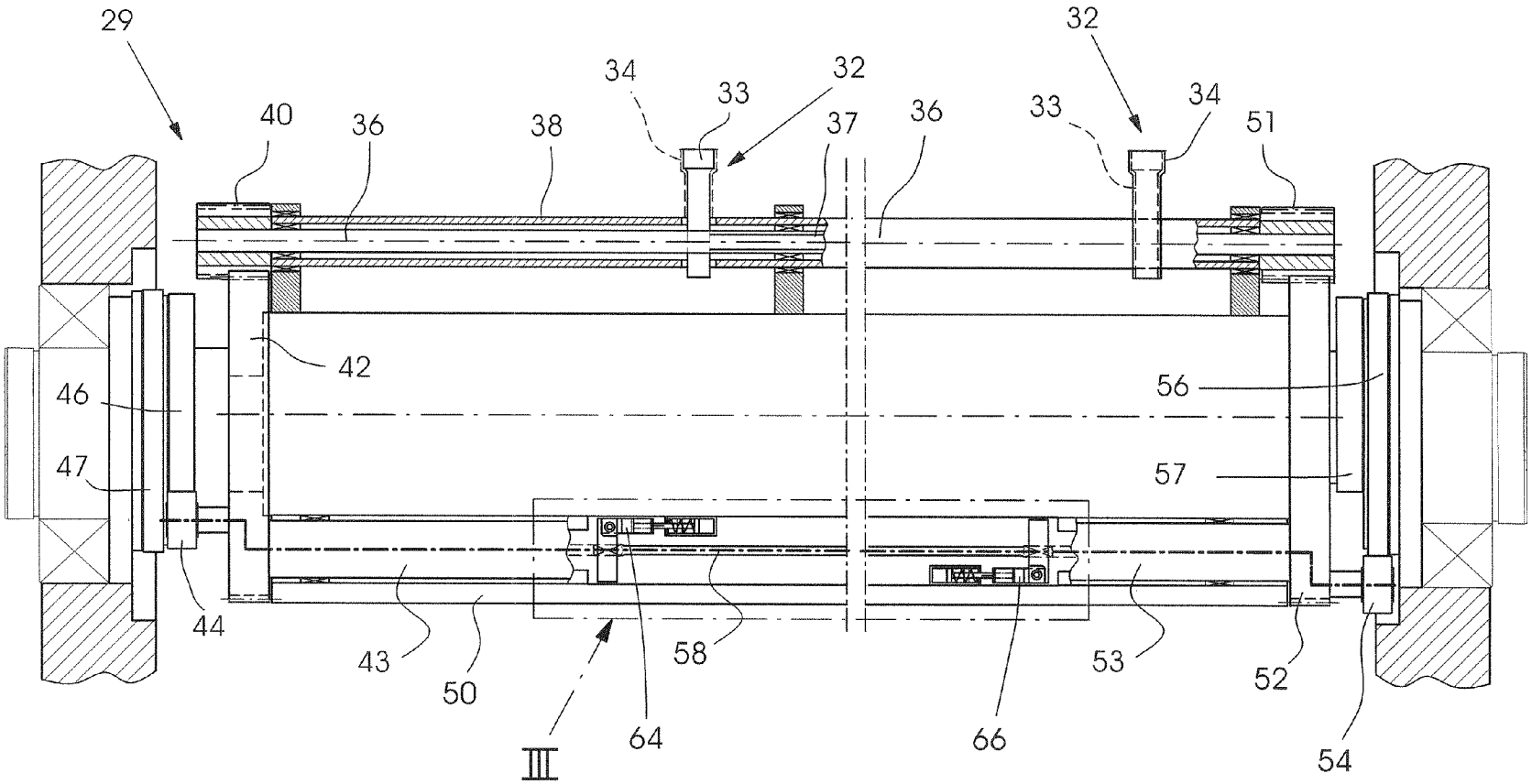
FIG. 2 is an enlarged, fragmentary, longitudinal-sectional view of a sheet reversing drum of the printing press.

As is shown in FIG. 2, the tongs-type gripper system 32 is made up of at least one rigid gripper 33 and a spring-mounted gripper 34. In the straight or single-sided printing mode, the rigid gripper 33 forms a gripper pad, and the spring-mounted gripper 34 forms a gripper finger. In the perfecting or recto-verso printing mode, the grippers 33 and 34 are pivotable about a common axis 36. The grippers 33 are seated on a gripper shaft 37 that is coaxially surrounded by a gripper tube 38. The grippers 34 are seated on the gripper tube 38. The entire gripper system 32 is pivotably mounted on the reversing drum 29.

A drive pinion 40 having teeth in engagement with a toothed segment 42, is seated at one end of the gripper tube 38. The toothed segment 42 has a journal 43 by which it is pivotably mounted on the reversing drum 29. A cam follower 44 is rotatably mounted on the toothed segment 42 opposite to but offset from the shaft 43. In the straight or single-sided printing mode, this cam follower 44 is in operative contact with a first control cam 46. For the perfecting or recto-verso printing mode, the cam follower 44 is disposed so as to be capable of being brought into contact with a second control cam 47. The control cam 47 and a control cam 57 control the pivoting movement of the gripper system 32 in the reversing mode. The control cam 46 and a control cam 56 control the gripper system 32 in the straight-printing mode.

A pinion 51 having teeth with which it is in engagement with a further toothed segment 52, is provided on an end of the gripper shaft 37 on a side opposite to that at which the pinion 40 is located. The toothed segment 52 is pivotably supported by a journal 53 on the reversing drum 29. A cam follower 54 rotatably supported on the toothed segment 52 is in operative connection with a control cam 56. The control cam 57 for the reversing mode is provided parallel and adjacent thereto. The journals or shafts 43, 53 are connected by a pre-tensioned torsion spring 58. Due to this configuration, the cam followers 44 and 54 are continually pressed against the control cams 46, 47 and 56, 57 associated therewith.

Figure 3:
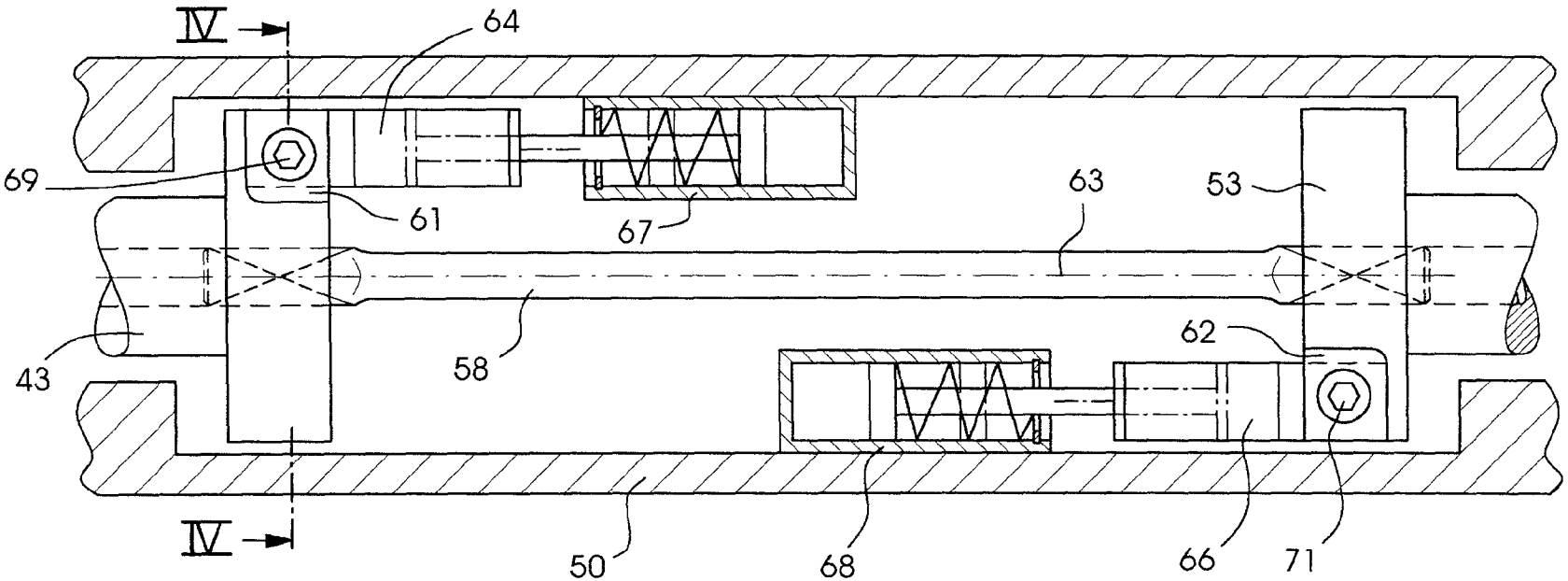
FIG. 3 is an enlarged, fragmentary, longitudinal-sectional view of a portion III of FIG. 2, further illustrating a locking mechanism of the sheet reversing drum.

FIG. 3 shows, in an enlarged view, the torsion spring 58 disposed between the journals 43 and 53 of the respective pivotable toothed segments 42 and 52 shown in FIG. 2. Each of the journals 43 and 53 has at least one respective stop 61 and 62 which, together with the respective journal 43, 53, reciprocatingly pivots, during operation, about an axis 63 of the torsion spring 58.

Figure 4:
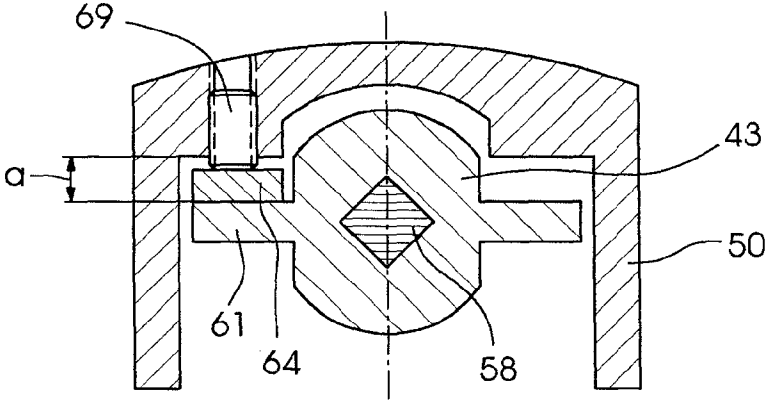
FIG. 4 is a cross-sectional view taken along a line IV-IV of FIG. 3 in the direction of the arrows.

A locking element, for example, in the form of a respective wedge 64, 66, is provided for every stop 61, 62. The respective wedge 64, 66 is disposed so as to be extensible into and retractable out of a gap or space a formed between the respective stop 61, 62 and a respective adjustable abutment 69, 71 disposed on the reversing drum 29, as is seen in FIG. 4. A respective actuator, for example a respective pneumatic cylinder 67, 68, is provided for thus extending and retracting the wedge 64, 66.

Figure 5:
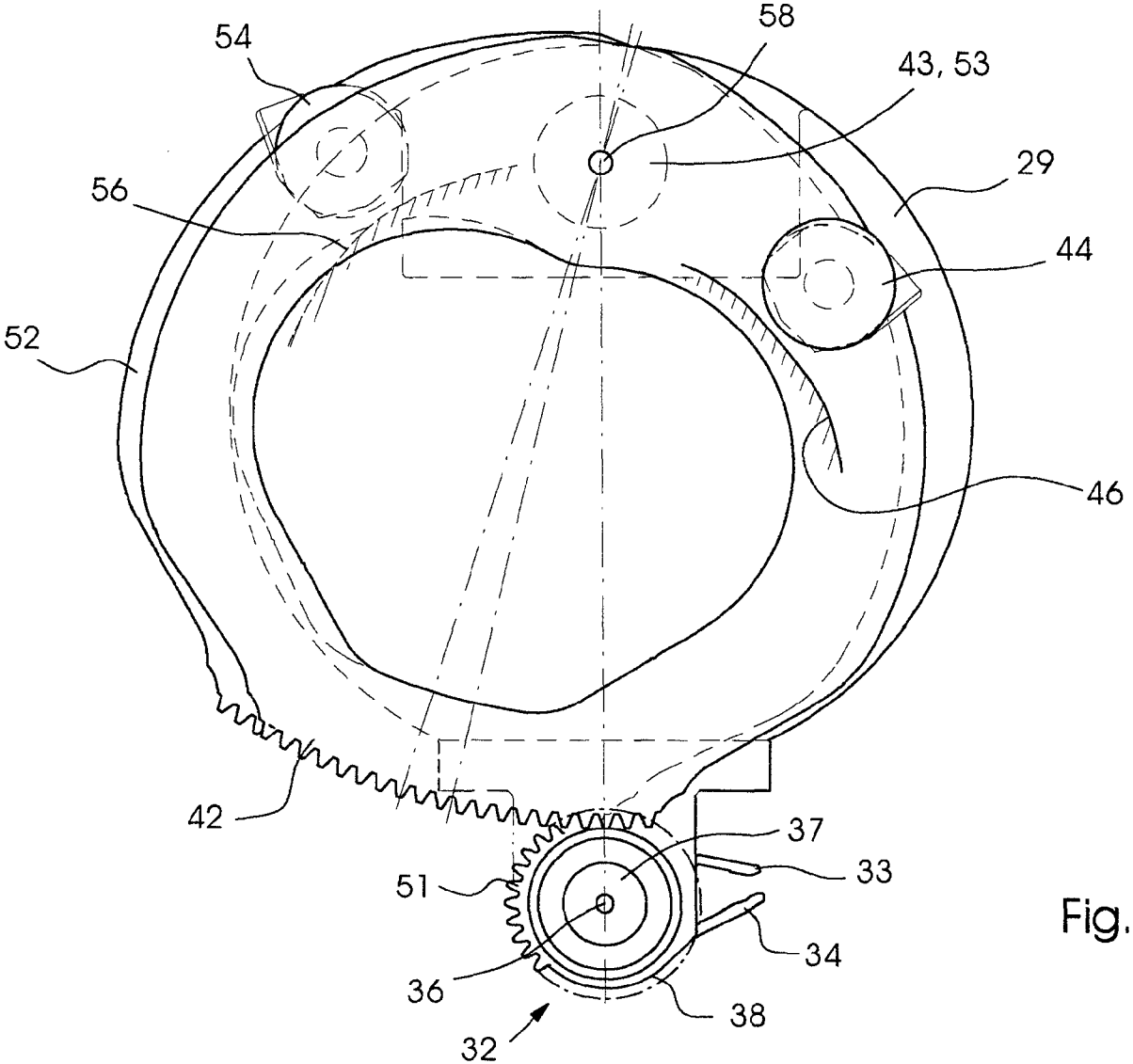
FIG. 5 is an enlarged, side-elevational view of the reversing drum showing cam followers thereof in disengaged position.

Prior to a conversion of the reversing drum 29, for example from the single-sided or straight-printing mode to the perfecting or recto-verso printing mode, and a concurrent disengagement of the cam followers 44, 54 from the control cams 46, 56 and engagement with the control cams 47, 57, the cam followers 44, 54 are locked in a position wherein they are disengaged from the control cams 46, 56. As a first step to achieve this aim, the reversing drum 29 is stopped in a first position wherein one of the two cam followers, for example the cam follower 44, has been displaced further than in the converting position. At the same time, the respective associated toothed segment and the stop on the journal have been displaced, so that the space and distance a between the stop 61 and the abutment 69 has been set. Then the pneumatic cylinder 67 operates to insert the wedge 64 into this space a. In a further step, the reversing drum 29 is rotated backwards or forwards to such an extent that the second cam follower 54 is disengaged from the control cam 46. In a manner corresponding to that of the first cam follower, the second cam follower 54 is locked in this position by pushing the wedge 66 into the space a between the stop 62 and the abutment 71. Then, the reversing drum 29 is rotated into the converting position. In this position, both cam followers 44 and 54 have now been disengaged from the cams 46 and 56, as shown in FIG. 5.

Once both cam followers 44 and 54 have been disengaged from their control cams, an axially displaceable adjustment unit, e.g., a carriage 50, that carries the cam followers 44 and 54, is displaced in the axial direction until the cam followers 44 and 54 are located in the region of the parallel control cams 47 and 57 for the perfecting or recto-verso mode. As the reversing drum 29 is rotated into appropriate positions, the cam followers 44 and 54 are reengaged with the respective control cams 46 and 56. Due to this measure, the journals can be rotated and thus the space a between the stops and abutments is increased, so that the wedges 64, 66 can be pulled out almost without friction. The conversion operation is thus completed.

Figure 6:
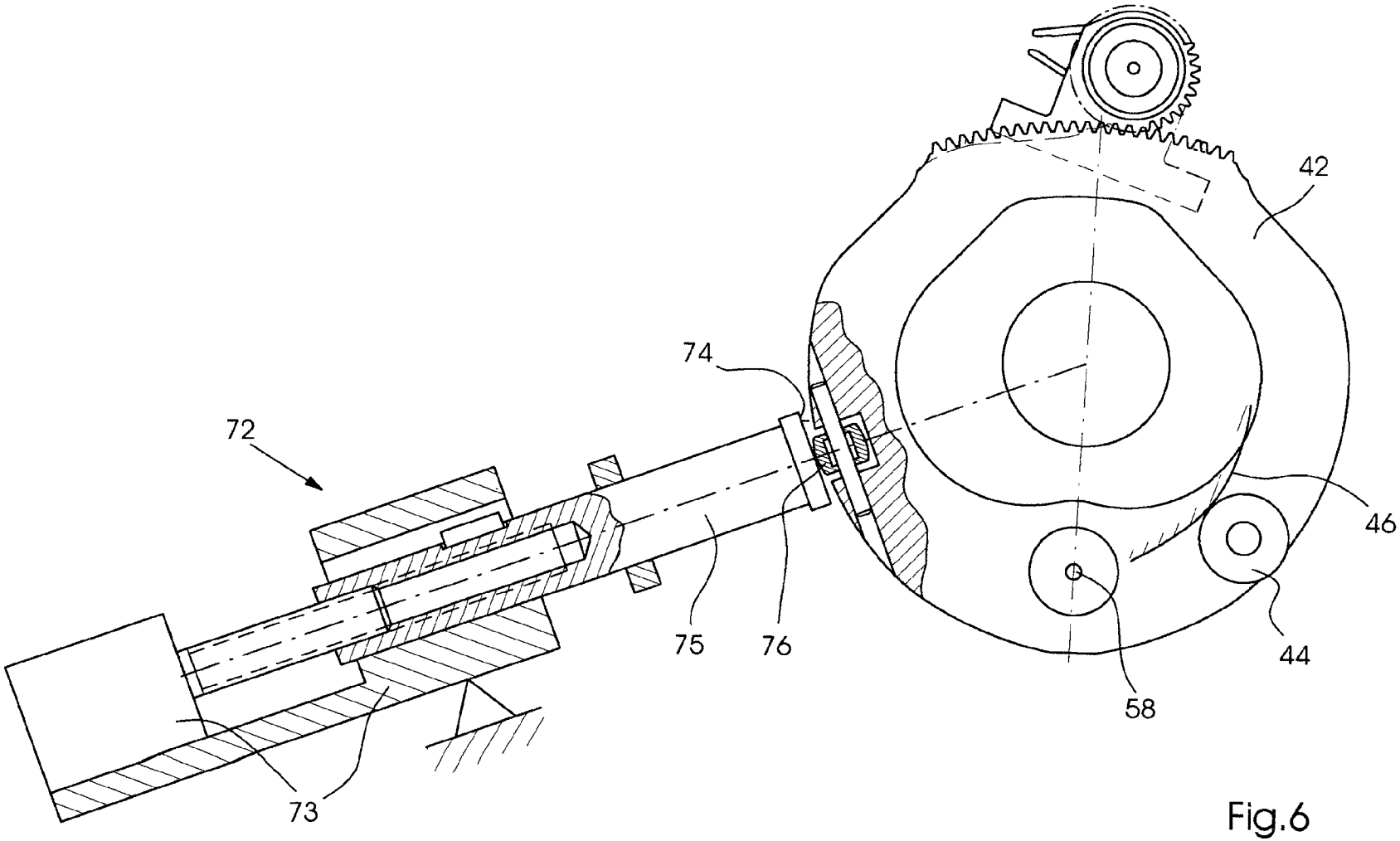
FIG. 6 is an enlarged, side-elevational view of another exemplary embodiment of the reversing drum with a locking element in a stationary configuration.

In a second exemplary embodiment shown in FIG. 6, a respective remotely-adjustable actuator 72, for example in the form of a motor spindle transmission 73, is supported on the side frame so as to be stationary. The actuator 72 includes a locking element 75 with a support surface 74, which acts on a support roller 76 that is disposed on the toothed segment 42, 52 so as to be capable of rotating. As a result, the toothed segments 42, 52, together with the cam followers 44, 54 disposed thereon, are disengageable from the associated control cam 46, 56 independently of the cylinder position. In the axial direction of the reversing drum 29, the support surface 74 is wide enough for the support roller 76 to roll on the support surface 74 during the conversion from straight or single-sided printing to perfecting or recto-verso printing, and vice versa.

Figure 7:
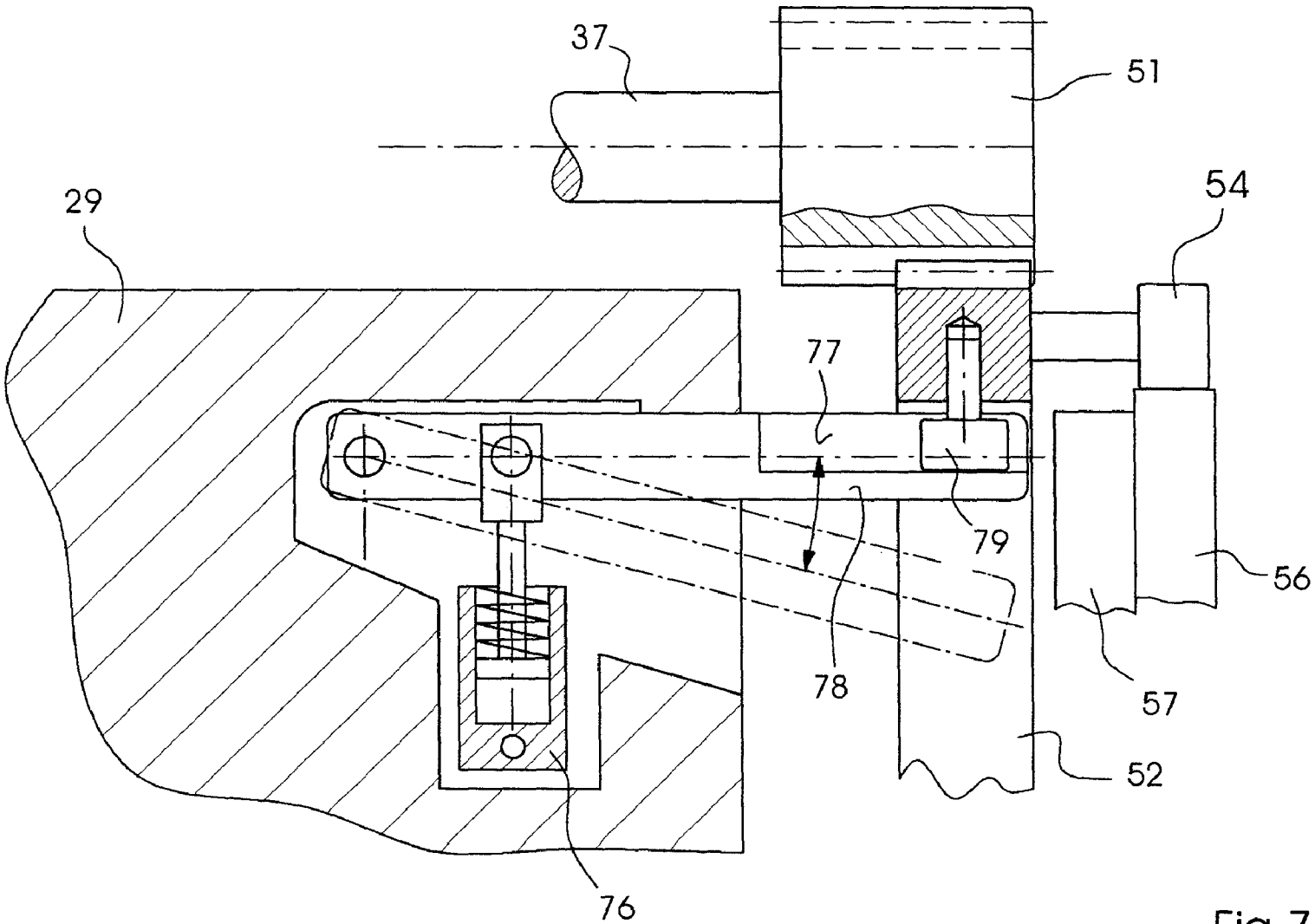
FIG. 7 is a further enlarged, fragmentary, partly longitudinal-sectional view of another exemplary embodiment with a locking element acting on a toothed segment of the reversing drum.

In a third exemplary embodiment shown in FIG. 7, the toothed segment 42, 52 carrying the cam follower 44, 54 is locked in a position wherein the respective cam follower 44, 54 is disengaged from the respective associated control cam. For this purpose, an actuator, for example in the form of a pneumatic cylinder 76, is provided on the reversing drum 29. The pneumatic cylinder 76 pivots a lever 78 provided with a roller guide 77 from a "rest position" into a "locking position." In the locking position, the lever 78 is in operative connection with a rotatable support roller 79 disposed on the toothed segment 52. During a conversion from straight or single-sided printing to perfecting or recto-verso printing, the support roller 79 can roll on the roller guide 77.

The invention claimed is:

1. A device for locking a cam follower in a position disengaged from a control cam cooperating with the cam follower, the device comprising:

a locking element associated with the cam follower;

an axially displaceable adjustment unit of a reversing drum;

said locking element being disposed on said axially displaceable adjustment unit;

an actuator for bringing said locking element from a rest position into a locking position; and a stop, said axially displaceable adjustment unit having an abutment, and said locking element being movable into a space between said stop and said abutment.

2. The locking device according to claim 1, which further comprises:

a toothed segment carrying said cam follower;

said toothed segment having a journal; and said stop being disposed on said journal.

3. The locking device according to claim 1, which further comprises:

a toothed segment having a support roller;

said locking element being a guide to be brought into operative contact with said support roller.

4. A reversing drum of a sheet-processing printing press, said reversing drum of the sheet-processing printing press comprising a device according to claim 1.

5. A method for converting a gripper system of a reversing drum between a straight or one-sided printing mode and a perfecting or recto-verso printing mode, the method comprising the following steps:

providing the device according to claim 1;

controlling pivoting and opening movements of grippers of the gripper system by the control cam;

initially locking the cam follower in a position disengaged from the control cam;

subsequently locking a further cam follower in a position disengaged from a further control cam; and subsequently converting the gripper system.

6. The method according to claim 5, which further comprises rotating the reversing drum to attain the disengaged positions.

7. The method according to claim 5, which further comprises attaining the disengaged positions with actuators actively pivoting the cam followers until reaching a corresponding spacing from the respective control cams.

* * * * *